US005659914A

United States Patent [19]

Steinlauf

[11] Patent Number: 5,659,914

[45] Date of Patent: Aug. 26, 1997

[54] METHOD FOR CONSTRUCTION OF FOOTWEAR

[75] Inventor: Fred A. Steinlauf, E. Windsor, N.J.

[73] Assignee: H.H. Brown Shoe Company, Inc., Greenwich, Conn.

[21] Appl. No.: 539,714

[22] Filed: Oct. 5, 1995

[51] Int. Cl.[6] ..... A43B 23/07

[52] U.S. Cl. ..... 12/145; 36/55; 36/12

[58] Field of Search ..... 36/14, 55, 12, 36/4; 12/145

[56] References Cited

U.S. PATENT DOCUMENTS

| | | | |
|---|---|---|---|
| 2,437,030 | 4/1948 | Hoza | 36/14 |
| 3,344,537 | 10/1967 | Diamant | 36/2.5 |
| 3,354,487 | 11/1967 | Glassman et al. | 12/142 |
| 3,942,206 | 3/1976 | Diamant | 12/142 R |
| 4,599,810 | 7/1986 | Sacre | 36/55 |
| 4,616,430 | 10/1986 | McQuiggin | 36/14 |
| 4,706,316 | 11/1987 | Tanzi | 12/142 T |
| 4,809,447 | 3/1989 | Pacanowsky et al. | 36/9 R |
| 4,899,465 | 2/1990 | Bleimhofer et al. | 36/14 |
| 5,289,644 | 3/1994 | Driskill et al. | 36/14 |
| 5,426,869 | 6/1995 | Gore et al. | 36/22 R |

*Primary Examiner*—Ted Kavanaugh
*Attorney, Agent, or Firm*—Fish & Richardson P.C.

[57] ABSTRACT

A method for construction of waterproof footwear includes providing an upper defining an internal volume for receiving and protecting a wearer's foot against external elements, lasting and securing an inner liner having a waterproofing layer within the internal volume of the upper, securing the inner liner at a lasting edge portion of the liner to an insole having an external surface, securing a gasket element over the lasting edge portion of the liner and external surface of the insole, lasting the upper over the inner liner, and securing an outsole to the lasted upper. Performing two independent lasting operations ensures that during use, even if water somehow penetrates the upper, the lasted inner lining provides independent protection to the wearer's foot.

6 Claims, 4 Drawing Sheets

METHOD FOR CONSTRUCTION OF FOOTWEAR

BACKGROUND OF THE INVENTION

The invention relates to footwear.

Shoes and boots are typically constructed with a permanent liner fixedly stitched within the interior to provide comfort and support.

In one conventional method for construction of a shoe or boot, an upper including an inner liner is pulled over a form, commonly known as a shoe last. While upon the last, the upper and inner liner are "wiped over" in overlying relationship onto an inner sole board and affixed thereto. An outsole and optional heel are then affixed to the outer surface of the inner sole board to complete the construction process.

SUMMARY OF THE INVENTION

In a general aspect of the invention, a method for construction of footwear includes providing an upper defining an internal volume for receiving and protecting a wearer's foot against external elements; lasting and securing an inner liner having a waterproofing layer within the internal volume of the upper; securing the inner liner at a lasting edge portion of the liner to an insole having an external surface; securing a gasket element over the lasting edge portion of the liner and external surface of the insole; lasting the upper over the inner liner; and securing an outsole to the lasted upper. Performing two independent lasting operations ensures that, during use, the wearer's foot is kept dry by the independently lasted inner liner, even if water somehow penetrates the upper.

In embodiments of the invention, the method may include one or any of the following additional steps. A waterproof sealing material is applied to seams of the inner liner. A cushioning layer and/or a thermal insulating layer may be provided within the inner liner. A reinforcement shank is provided on the rear part of the insole between the gasket element and the portion of the external surface of the insole. A waterproofing substance is applied over an external surface of the upper.

Other advantages and features of the invention will be apparent from the following description of presently preferred embodiments, and from the claims.

BRIEF DESCRIPTION OF THE DRAWINGS

FIG. 4 is a similar bottom perspective view of the gasket element attached over the insole, while

DESCRIPTION OF THE PREFERRED EMBOIDMENTS

Figure 1:
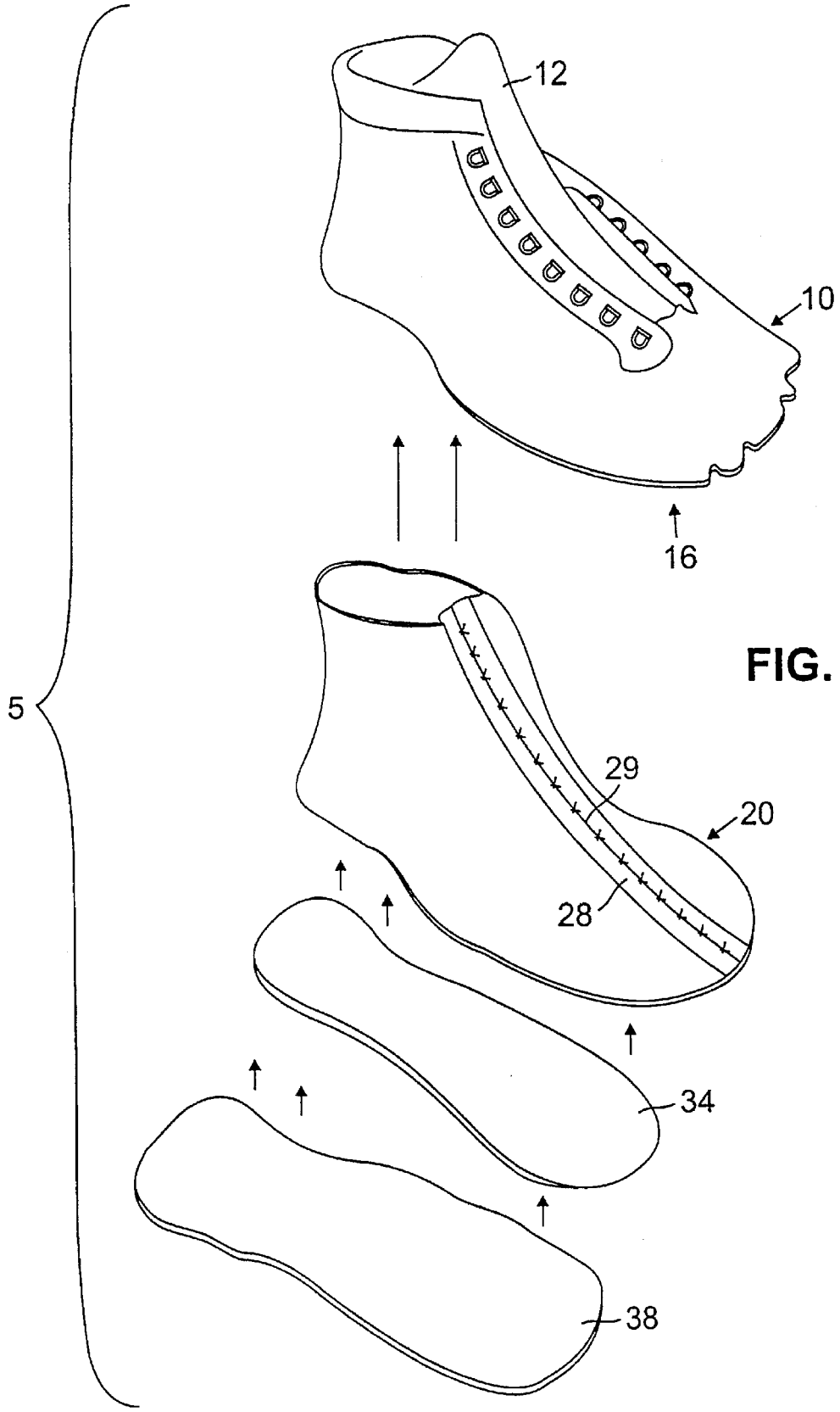
FIG. 1 is an exploded perspective view of a shoe, consisting of a shoe upper, an inner liner, an insole board, and a gasket element.

Referring to FIG. 1, a footwear assembly 5 includes a shoe upper 10, preferably made from leather, having a tongue 12 extending into a vamp portion of the upper, and eyelets 14 for receiving conventional front lacing (not shown). The shoe upper 10 is shown free-floating, with its bottom portion 16 open to what will be the internal volume of the shoe. Shoe upper 10 is preferably treated or processed during tannage with oil, wax, or other waterproofing substances to provide protection of the leather against water.

Figure 2:
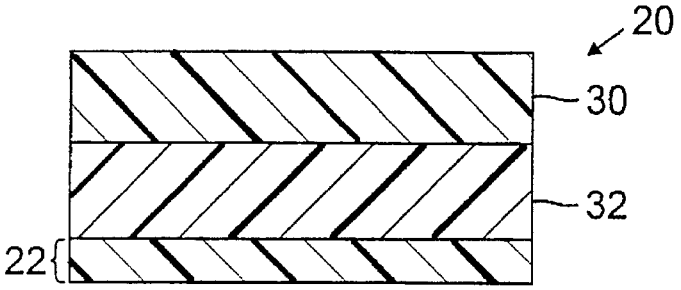
FIG. 2 is a cross-sectional view of the inner liner of FIG. 1.

An inner liner 20, which is to be inserted within upper 10, as described below, is fabricated of materials selected to provide comfort to the wearer during use of the footwear in cold or wet weather. In particular, referring to FIG. 2, inner liner 20 consists of an outer layer 22 formed of a waterproof, breathable laminate, e.g. including DuroTech™ membrane (as manufactured by Hub Fabric Leather Company, Inc., Everett, Mass.) to provide a barrier between water (e.g., absorbed through the upper) and the wearer's foot other waterproof, breathable materials may, be alternatively used in the laminate. Inner liner 20 also includes an inside layer 30 formed of a polyester material for absorbing perspiration from the foot of the wearer, and a channelized intermediate foam layer 32, e.g. about 2 to 3 millimeters thick, positioned between inside layer 30 and outer layer 22 to provide cushioning to the wearer's foot, and also to facilitate air circulation around the foot. In some embodiments, inside layer 30 may be decoratively quilted to provide an aesthetically pleasing look to the interior surface of the shoe. Non-porous sealing tape 28 (FIG. 1) is heat sealed over the seams 29 between panel portions of the inner liner to prevent moisture from penetrating through the seams of the bootie toward the wearer's foot. In the alternative, sealing tape fabricated from the same or similar waterproofing membrane used for outer layer 22 may be used to seal the seams.

Inner liner 20 is stitched within shoe upper 10. At this stage of construction, the shoe is said to be a stitched upper with bottom portions of both upper 10 and inner liner 20 open.

Figure 3:
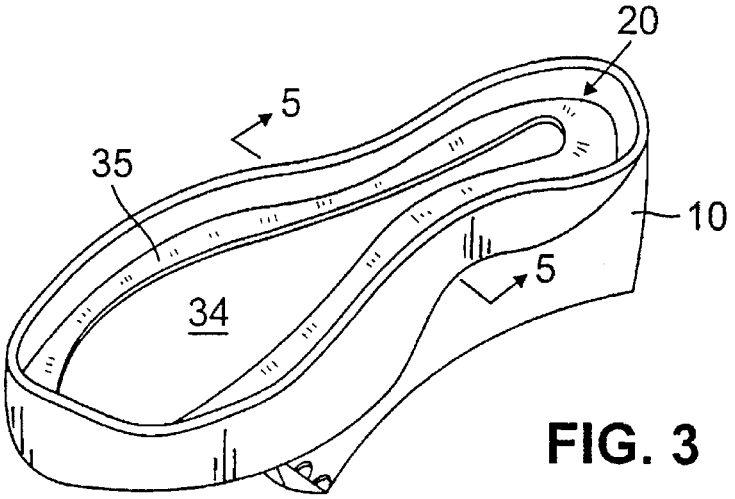
FIG. 3 is a bottom perspective view of the inner liner lasted within the shoe upper.

Referring to FIG. 3, an insole board 34 is temporarily tacked to a shoe last (not shown), which is presented to the stitched upper (i.e.r shoe upper 10 and inner liner 20). SA first lasting operation is performed with only the inner liner 20 "wiped" in overlying relationship to the insole board 34. A conventional adhesive may be used to permanently bond the wiped-over flange portion 35 of inner liner 20 to the insole board. A reinforcing shank 36 (FIG. 6), fabricated from metal or other rigid material, may be positioned over the rear portion of the exposed outer surface of insole board 34. The tacks are removed and the holes "gunked" or sealed using a suitable waterproof substance. To ensure a waterproof barrier between the inner liner and the shoe upper, nails and tacks are not used beyond this stage of construction.

Figure 4:
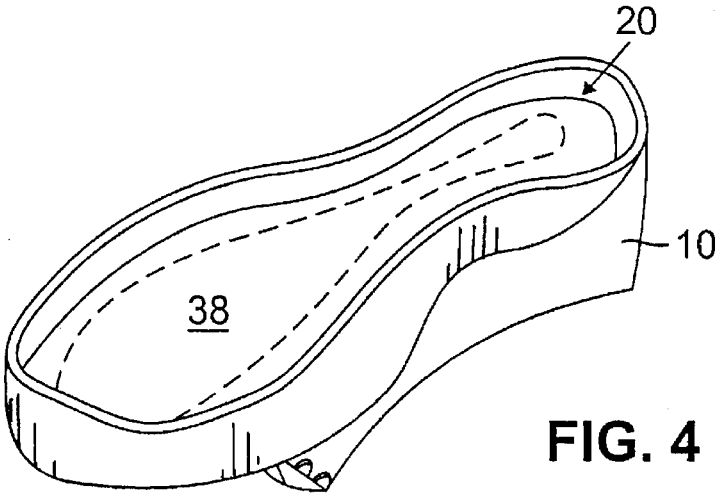
Figure 5:
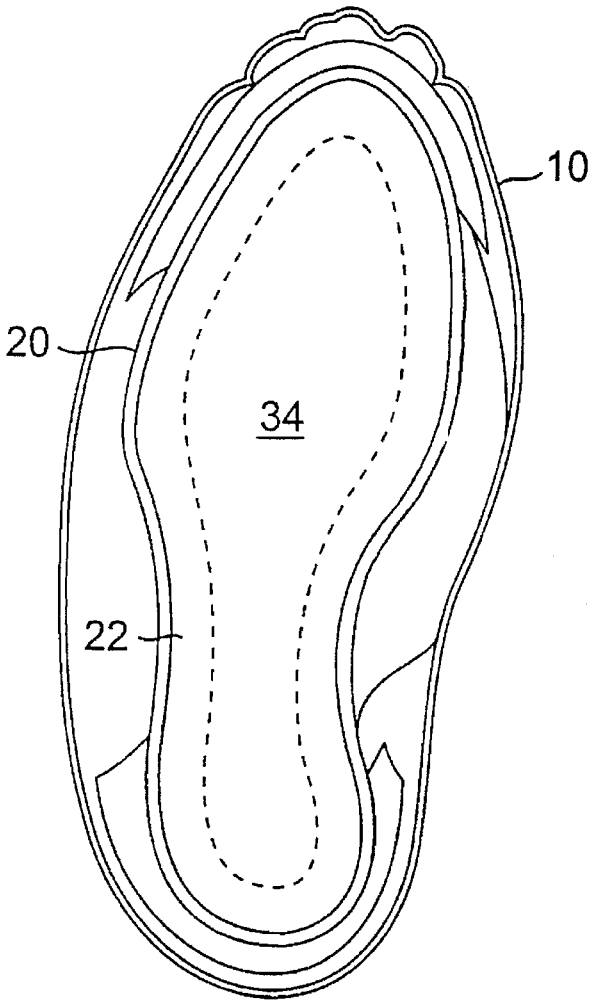
FIG. 5 is a bottom view thereof.

Referring to FIGS. 4 and 5, a gasket element 38 is secured over the flange portion 35 and exposed surface of shank 36 using a suitable adhesive. (The edge of flange portion 35 below gasket element 38 is shown dashed line.) At this stage of construction, the shoe appears from the bottom as a waterproof bootie stitched within an open-bottomed upper.

Figure 6:
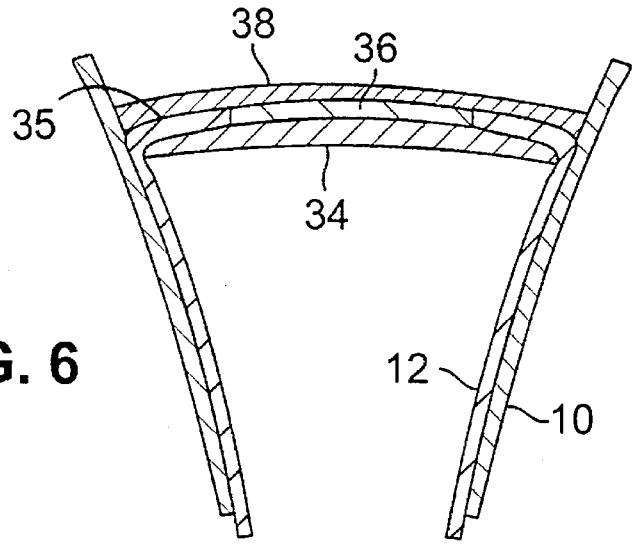
FIG. 6 is sectional view of the inner liner lasted within the shoe upper, as taken along line 5—5 of FIG. 3.
Figure 7:
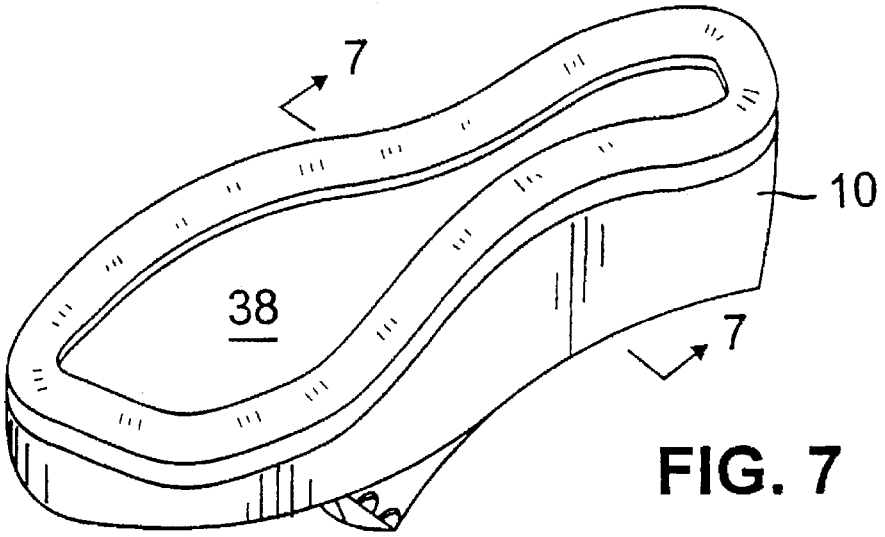
FIG. 7 is a bottom perspective view of the lasted upper.

Referring now to FIGS. 6 and 7, with the stitched upper and waterproof bootie still attached to the last, shoe upper 10 is lasted in a second lasting operation, with the bottom edge flange portions of the upper wiped over and glued to the gasket element 38. Performing two independent lasting operations ensures that, during use, even if water somehow penetrates upper 10, the lasted inner lining provides independent protection to the wearer's foot.

Figure 8:
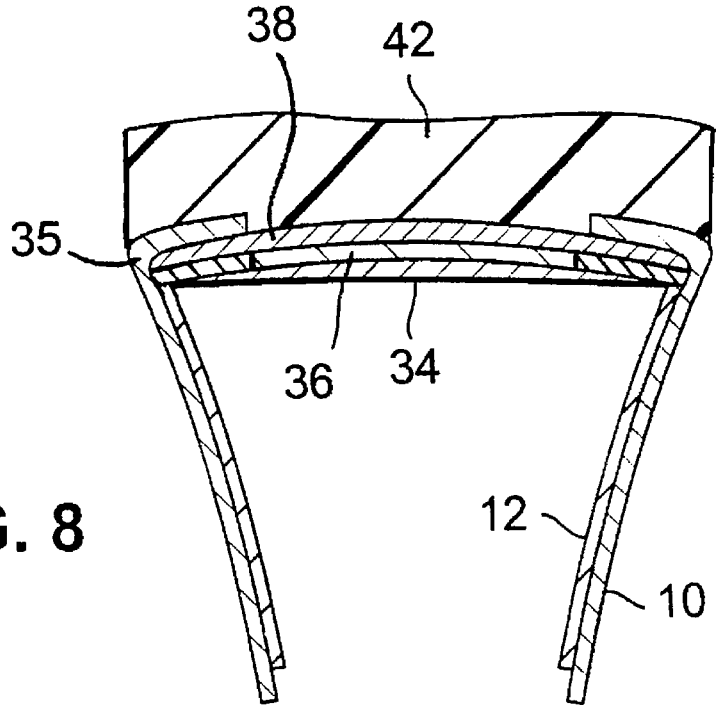
FIG. 8 is sectional view taken of the lasted upper, as taken along line 7—7 of FIG. 6.

The shoe is then removed from the last and, as shown in FIG. 8, an outsole 42 of rubber, leather, plastic, or other suitable material is adhesively bonded upon the bottom of the lasted upper and insole liner.

Other embodiments are within the following claims.

What is claimed is:

1. A method for construction of footwear comprising the steps of:

providing an upper defining a volume for receiving and protecting a wearer's foot against external elements;

providing an inner liner having a waterproofing layer;

securing the inner liner having a waterproofing layer within the internal volume of the upper;

lasting the inner liner at a lasting edge portion of the liner to an insole having an external surface;

securing a gasket element over the lasting edge portion of the liner and external surface of the insole;

lasting, in an operation separate from lasting the inner liner, the upper over the inner liner and qasket; and securing an outsole to the upper.

2. The method of claim 1 further comprising the step of, prior to securing the gasket element, applying a waterproof sealing material within seams between elements of the inner liner.

3. The method of claim 1 further comprising the step of providing a cushioning layer within the inner liner.

4. The method of claim 1 further comprising the step of providing a thermally insulating layer within the inner liner.

5. The method of claim 1 further comprising the step of providing a reinforcement shank between the gasket element and the external surface of the insole.

6. The method of claim 1 further comprising the step of applying a waterproofing substance over an external surface of the upper.

* * * * *